US008466942B2

(12) United States Patent
Daicho

(10) Patent No.: US 8,466,942 B2
(45) Date of Patent: Jun. 18, 2013

(54) THERMAL PRINT HEAD

(75) Inventor: Syojiro Daicho, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 39 days.

(21) Appl. No.: 13/314,516

(22) Filed: Dec. 8, 2011

(65) Prior Publication Data

US 2012/0147118 A1 Jun. 14, 2012

(30) Foreign Application Priority Data

Dec. 10, 2010 (JP) ..... 2010-275483

(51) Int. Cl.
*B41J 2/335* (2006.01)

(52) U.S. Cl.
USPC ..... 347/202

(58) Field of Classification Search
USPC ..... 347/200–211
See application file for complete search history.

(56) References Cited

U.S. PATENT DOCUMENTS

| | | | | |
|---|---|---|---|---|
| 6,614,460 | B2 * | 9/2003 | Susukida et al. | 347/202 |
| 7,046,265 | B2 * | 5/2006 | Shirakawa et al. | 347/202 |
| 2010/0289862 | A1 * | 11/2010 | Yamade | 347/200 |

FOREIGN PATENT DOCUMENTS

| | | |
|---|---|---|
| JP | 2001-232838 | 8/2001 |

* cited by examiner

*Primary Examiner* — Kristal Feggins
(74) *Attorney, Agent, or Firm* — Hamre, Schumann, Mueller & Larson, P.C.

(57) ABSTRACT

A thermal print head includes a substrate, an electrode layer supported on the substrate and provided with a plurality of mutually spaced-apart portions, a resistor layer provided with a plurality of heating portions arranged along a primary scanning direction, the heating portions lying across the spaced-apart portions, and a protective layer configured to cover the resistor layer, the protective layer including a first layer made of glass matrix and a plurality of alumina grains mixed into the glass matrix.

23 Claims, 11 Drawing Sheets

THERMAL PRINT HEAD

CROSS-REFERENCE TO RELATED APPLICATION

This application is based upon and claims the benefit of priority from Japanese Patent Applications No. 2010-275483 filed on Dec. 10, 2010, the entire contents of which are incorporated herein by reference.

TECHNICAL FIELD

The present disclosure relates to a thermal print head.

BACKGROUND

FIG. 11 partially illustrates one example of a conventional thermal print head (see, e.g., JP2001-232838A). A thermal print head 90 shown in FIG. 11 includes a partial glaze 91 formed on a substrate (not shown). The partial glaze 91 is made of glass and has an arc-like strip-shaped cross section in a primary scanning direction x. An electrode layer 92 and a resistor layer 93 are formed one above another on the partial glaze 91. Heat needed to perform printing is generated by partially applying an electric current to the resistor layer 93 through the electrode layer 92. The electrode layer 92 and the resistor layer 93 are covered with a protective layer 94. The protective layer 94 is made of, e.g., glass, and is provided to protect the electrode layer 92 and the resistor layer 93.

In recent years, printing speed has been increasing. Along with the diversification of print medium, it is sometimes the case that a print medium containing a relatively hard material is put to use. These types of print medium are major culprits of scratching the protective layer 94. The protective layer 94 is required to be scratch-resistant and needs to have a smooth surface suitable for printing.

SUMMARY

In view of the circumstances noted above, it is an object of the present disclosure to provide a thermal print head suitable for high-speed printing and capable of properly printing on different kinds of print medium.

A thermal print head according to one aspect of the present disclosure includes: a substrate; an electrode layer supported on the substrate and provided with a plurality of mutually spaced-apart portions; a resistor layer provided with a plurality of heating portions arranged along a primary scanning direction, the heating portions lying across the spaced-apart portions; and a protective layer configured to cover the resistor layer, the protective layer including a first layer made of a glass matrix and a plurality of alumina grains mixed into the glass matrix.

In one embodiment of the present disclosure, the alumina grains may have a spherical shape.

In another embodiment of the present disclosure, the alumina grains may include first alumina grains and second alumina grains smaller in diameter than the first alumina grains.

In yet another embodiment of the present disclosure, the first layer may have a thickness twice to three times as great as the diameter of the first alumina grains.

In yet another embodiment of the present disclosure, the diameter of the second alumina grains may be equal to or smaller than one half of the diameter of the first alumina grains.

In yet another embodiment of the present disclosure, the first alumina grains and the second alumina grains may be mixed in a mixing ratio of 2:1 to 1:1.

In yet another embodiment of the present disclosure, the first layer may have a thickness twice to three times as great as the diameter of the alumina grains.

In yet another embodiment of the present disclosure, the alumina grains in the first layer may have a concentration of 50 to 70 wt %.

In yet another embodiment of the present disclosure, an occupying percentage of the alumina grains in the first layer may be increased toward the resistor layer along a thickness direction of the first layer.

In yet another embodiment of the present disclosure, the glass matrix of the first layer may be made of amorphous glass.

In yet another embodiment of the present disclosure, the protective layer may further include a second layer interposed between the first layer and the resistor layer.

In yet another embodiment of the present disclosure, the second layer may be made of amorphous glass.

In yet another embodiment of the present disclosure, the first layer may have a softening point higher than a softening point of the second layer.

In yet another embodiment of the present disclosure, the thermal print head may further include: a partial glaze made of glass, the partial glaze interposed between the substrate and the spaced-apart portions of the electrode layer, the partial glaze overlapping with the plurality of the heating portions when seen in a thickness direction of the substrate, the partial glaze extending in the primary scanning direction and having an arc-like strip-shaped cross-section, the first layer and the second layer extending beyond a terminal edge of the partial glaze in a secondary scanning direction.

In yet another embodiment of the present disclosure, the thermal print head may further include: a die-bonding glaze provided in a position spaced apart from the partial glaze in the secondary scanning direction and an intermediate glass layer formed to cover an area of the substrate interposed between the partial glaze and the die-bonding glaze, the second layer extending beyond the intermediate glass layer to the die-bonding glaze, the first layer provided with a secondary scanning direction terminal edge overlapping with the intermediate glass layer.

In yet another embodiment of the present disclosure, the thermal print head may further include: a tip end glass layer configured to cover an area of the substrate positioned at the opposite side of the partial glaze from the intermediate glass layer, the first layer and the second layer extending beyond a terminal edge of the tip end glass layer in the secondary scanning direction.

In yet another embodiment of the present disclosure, the electrode layer may include: a common electrode provided with a connecting portion extending in the primary scanning direction and a plurality of strip-shaped portions extending from the connecting portion in the secondary scanning direction; and a plurality of individual electrodes provided with strip-shaped portions extending in the secondary scanning direction and lying between the strip-shaped portions of the common electrode adjoining to each other in the primary scanning direction, the resistor layer intersecting the plurality of the strip-shaped portions of the common electrode and the strip-shaped portions of the plurality of the individual electrodes and extending in the secondary scanning direction.

In yet another embodiment of the present disclosure, the electrode layer may contain Au and the thermal print head may further include: an auxiliary electrode layer containing Ag, the auxiliary electrode layer configured to at least partially cover the connecting portion, the first layer and the second layer extending beyond a terminal edge of the auxiliary electrode layer in the secondary scanning direction.

In yet another embodiment of the present disclosure, the thermal print head may further include: a partial glaze made of glass, the partial glaze interposed between the substrate and the spaced-apart portions of the electrode layer, the partial glaze overlapping with the plurality of the heating portions when seen in a thickness direction of the substrate, the partial glaze extending in the primary scanning direction and having an arc-like strip-shaped cross section, the first layer extending beyond a terminal edge of the partial glaze in a secondary scanning direction.

In yet another embodiment of the present disclosure, the thermal print head may further include: a die-bonding glaze provided in a position spaced apart from the partial glaze in the secondary scanning direction and an intermediate glass layer formed to cover an area of the substrate interposed between the partial glaze and the die-bonding glaze, the first layer extending beyond the intermediate glass layer to the die-bonding glaze.

In yet another embodiment of the present disclosure, the thermal print head may further include: a tip end glass layer configured to cover an area of the substrate positioned at the opposite side of the partial glaze from the intermediate glass layer, the first layer extending beyond a terminal edge of the tip end glass layer in the secondary scanning direction.

In yet another embodiment of the present disclosure, the electrode layer may include: a common electrode provided with a connecting portion extending in the primary scanning direction and a plurality of strip-shaped portions extending from the connecting portion in the secondary scanning direction; and a plurality of individual electrodes provided with strip-shaped portions extending in the secondary scanning direction and lying between the strip-shaped portions of the common electrode adjoining to each other in the primary scanning direction, the resistor layer intersecting the plurality of strip-shaped portions of the common electrode and the strip-shaped portions of the plurality of individual electrodes and extending in the secondary scanning direction.

In yet another embodiment of the present disclosure, the electrode layer may contain Au, and the thermal print head may further include: an auxiliary electrode layer containing Ag, the auxiliary electrode layer configured to at least partially cover the connecting portion, the first layer extending beyond a terminal edge of the auxiliary electrode layer in the secondary scanning direction.

Other features and advantages of the present disclosure will become more apparent from the detailed description made in conjunction with the accompanying drawings.

DETAILED DESCRIPTION

Figure 1:
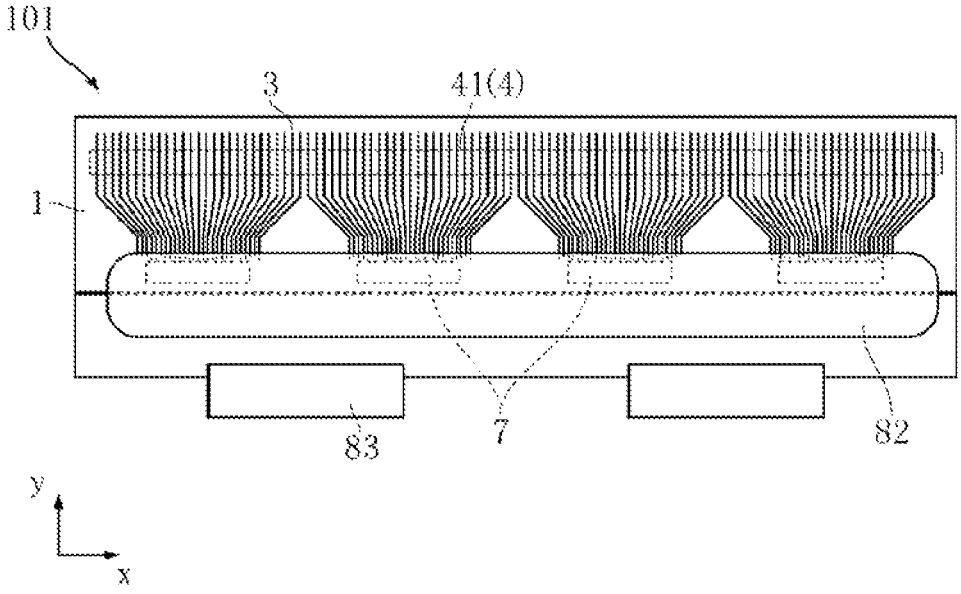
FIG. 1 is a plan view showing a thermal print head according to a first embodiment of the present disclosure.

Certain preferred embodiments will now be described in detail with reference to the drawings.

FIGS. 1 through 5 show a thermal print head according to a first embodiment of the present disclosure. The thermal print head 101 of the present embodiment includes a substrate 1, a glaze layer 2, an electrode layer 3, a resistor layer 4, a protective layer 5 and a drive IC 71. The thermal print head 101 is incorporated into a printer for printing on thermal paper to print, e.g., a barcode sheet or a receipt. For the sake of understanding, the protective layer 5 is omitted in FIG. 1.

The substrate 1 is made of e.g., ceramic such as $Al_2O_3$, and has a thickness of, e.g., about 0.6 to 1.0 mm. As shown in FIG. 1, the substrate 1 is formed into an elongated rectangular shape extending in a primary scanning direction x. In addition to the substrate 1, it may be possible to employ a structure having a wiring substrate in which a base layer made of, e.g., a glass epoxy resin, and a wiring layer made of, e.g., Cu, are laminated one above another. A heat radiating plate made of metal, e.g., Al, may be provided on the lower surface of the substrate 1.

The glaze layer 2 is formed on the substrate 1 and is made of a glass material, e.g., amorphous glass. The glass material has a softening point of e.g., 800 to 850 degrees C. The glaze layer 2 includes a partial glaze 21 and a die-bonding glaze 22. The glaze layer 2 is formed by thick-film printing glass paste and then sintering the glass paste thus printed.

Figure 2:
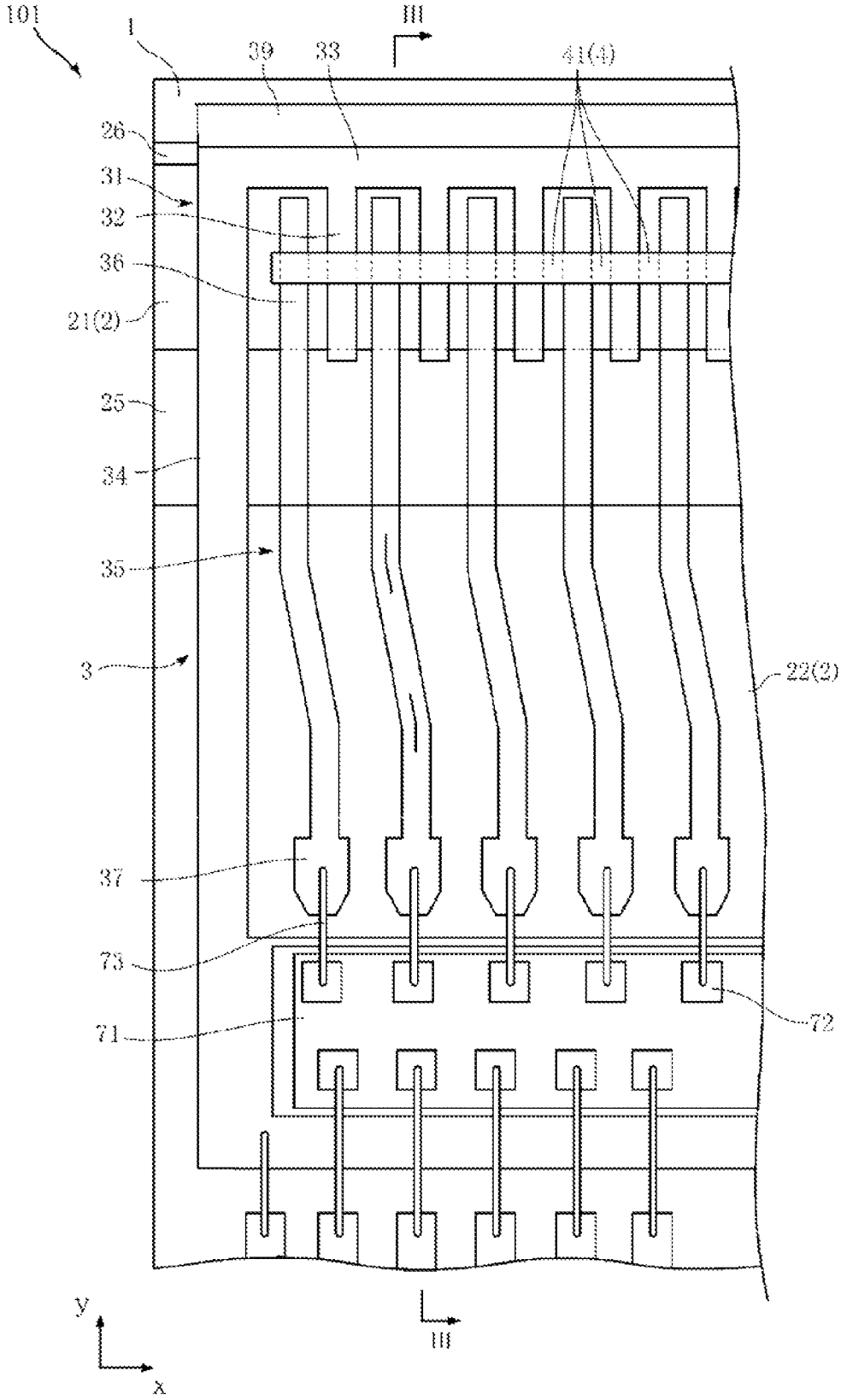
FIG. 2 is a plan view of major portions of the thermal print head shown in FIG. 1.
Figure 3:
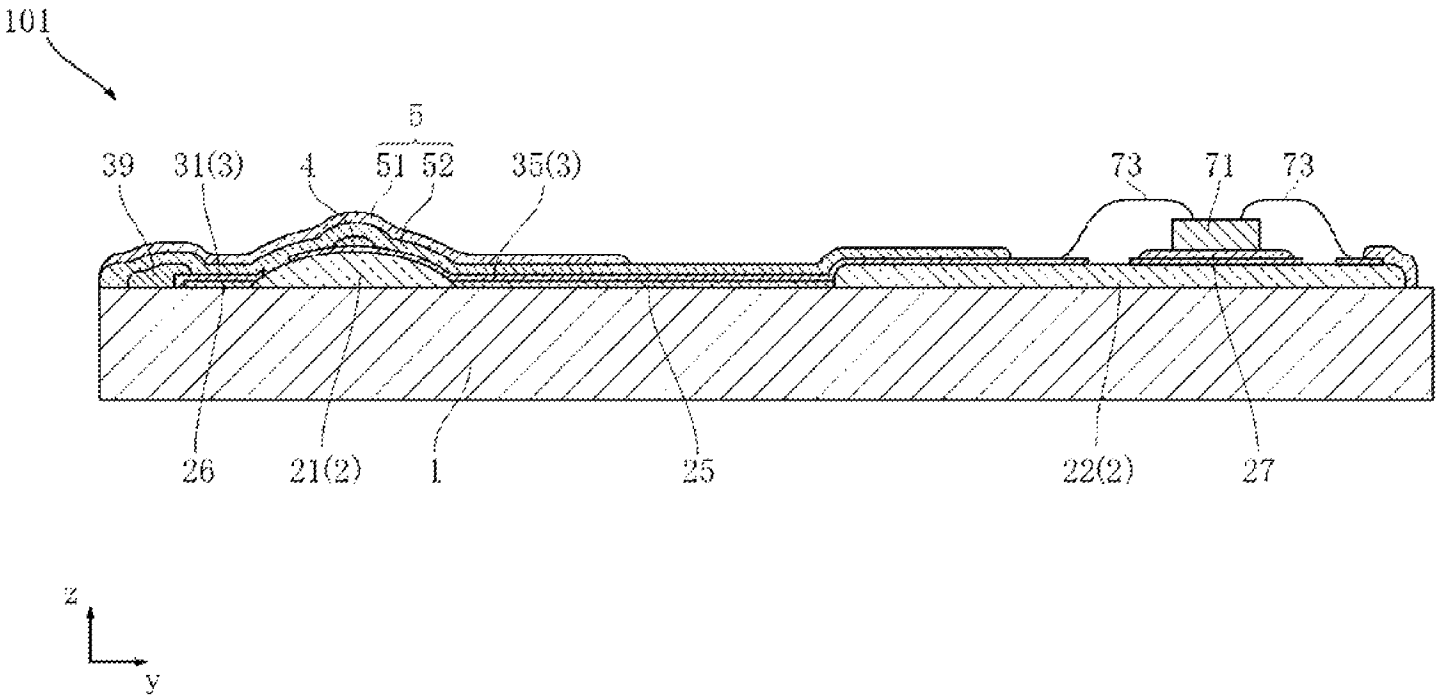
FIG. 3 is a section view of the thermal print head taken along line in FIG. 2.
Figure 4:
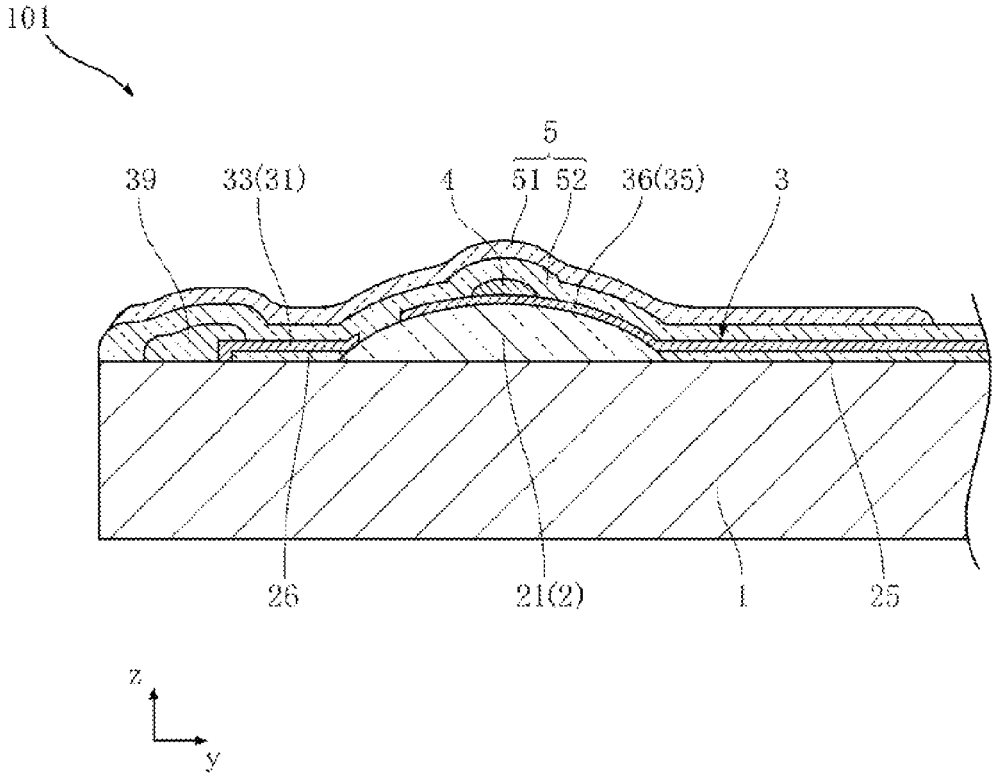
FIG. 4 is an enlarged section view of major portions of the thermal print head shown in FIG. 1.

The partial glaze 21 extends in the primary scanning direction x as shown in FIG. 2 and has an arc-like cross-sectional shape on a y-z plane containing a secondary scanning direction y and a thickness direction z as shown in FIGS. 3 and 4. The partial glaze 21 is sized such that the dimension thereof in the secondary scanning direction y is, e.g., about 700 μm, and the dimension thereof in the thickness direction z is, e.g., about 18 to 50 μm. The partial glaze 21 is provided to press the heating area of the resistor layer 4 against thermal paper as a print target.

The die-bonding glaze 22 is provided in a position spaced apart from the partial glaze 21 in the secondary scanning direction y. The die-bonding glaze 22 supports a portion of the electrode layer 3 and the drive IC 71. The die-bonding glaze 22 has a thickness of, e.g., about 30 to 50 μm.

The area of the substrate 1 interposed between the partial glaze 21 and the die-bonding glaze 22 is covered with an intermediate glass layer 25. The intermediate glass layer 25 has a softening point of e.g., 680 degrees C., and is made of glass whose softening point is lower than the softening point of the glass making up the glaze layer 2. The intermediate glass layer 25 has a thickness of e.g., about 2.0 μm. As shown in FIGS. 3 and 4, a portion of the area of the substrate 1 existing at the left side of the partial glaze 21 is covered with a tip end glass layer 26. The tip end glass layer 26 has the same material and thickness as the intermediate glass layer 25. The intermediate glass layer 25 and the tip end glass layer 26 are formed by thick-film printing glass paste and then sintering the glass paste thus printed.

The electrode layer 3 is provided to define a route for applying an electric current the resistor layer 4 and is made of, e.g., resinate Au added with additives such as rhodium, vanadium, bismuth and silicon. The electrode layer 3 is formed by thick-film printing resinate Au paste and then sintering the resinate Au paste thus printed. The electrode layer 3 may be formed by laminating a plurality of Au layers one above another. The electrode layer 3 has a thickness of, e.g., about 0.6 to 1.2 μm. The electrode layer 3 includes a common electrode 31 and a plurality of individual electrodes 35.

The common electrode 31 includes a connecting portion 33, a plurality of strip-shaped portions 32 and a detouring portion 34. As shown in FIGS. 2 and 3, the connecting portion 33 is arranged near one end of the substrate 1 in the secondary scanning direction y. The connecting portion 33 extends in the primary scanning direction x and has a strip-like shape. The strip-shaped portions 32 extend from the connecting portion 33 toward the partial glaze 21 in the secondary scanning direction y. The strip-shaped portions 32 are arranged at a regular pitch along the primary scanning direction x. The detouring portion 34 extends from one end in the primary scanning direction x of the connecting portion 33 along the secondary scanning direction y.

The individual electrodes 35 are provided to partially apply the electric current to the resistor layer 4 and have the opposite polarity to the common electrode 31. The individual electrodes 35 are arranged along the primary scanning direction x. Each of the individual electrodes 35 includes a strip-shaped portion 36 and a bonding portion 37. The strip-shaped portion 36 extends in the secondary scanning direction y and has a strip-like shape. The strip-shaped portion 36 is positioned between two mutually-adjoining strip-shaped portions 32 on the partial glaze 21. The bonding portion 37 is provided at one end of the strip-shaped portion 36 in the secondary scanning direction y.

As shown in FIGS. 2 through 4, the connecting portion 33 is partially covered with an auxiliary electrode layer 39. The auxiliary electrode layer 39 is made of, e.g., Ag. The auxiliary electrode layer 39 extends in the primary scanning direction x and has a strip-like shape. The auxiliary electrode layer 39 is covered with the protective layer 5.

The resistor layer 4 is made of, e.g., ruthenium oxide greater in resistivity than the material of which the electrode layer 3 is made. The resistor layer 4 extends in the primary scanning direction x and has a strip-like shape. The resistor layer 4 is positioned substantially in the central area of the partial glaze 21 to intersect the strip-shaped portions 32 and the strip-shaped portions 36. The portions of the resistor layer 4 interposed between the strip-shaped portions 32 and the strip-shaped portions 36 serve as heating portions 41. The heating portions 41 are heated when the electric current is partially applied by the electrode layer 3. Print dots are formed by the heating of the heating portions 41.

The protective layer 5 is provided to protect the electrode layer 3 and the resistor layer 4. In the present embodiment, the protective layer 5 includes an upper layer 51 and a lower layer 52 laminated one above another. The lower layer 52 is one example of a second layer referred to herein. In the present embodiment, the lower layer 52 is made of amorphous glass having a softening point of about 700 degrees C. As shown in FIGS. 3 and 4, the lower layer 52 is formed in an area ranging from the left end of the substrate 1 to around the center of the die-bonding glaze 22 of the glaze layer 2 in the secondary scanning direction y. The lower layer 52 has a thickness of, e.g., about 6 to 8 μm.

Figure 5:
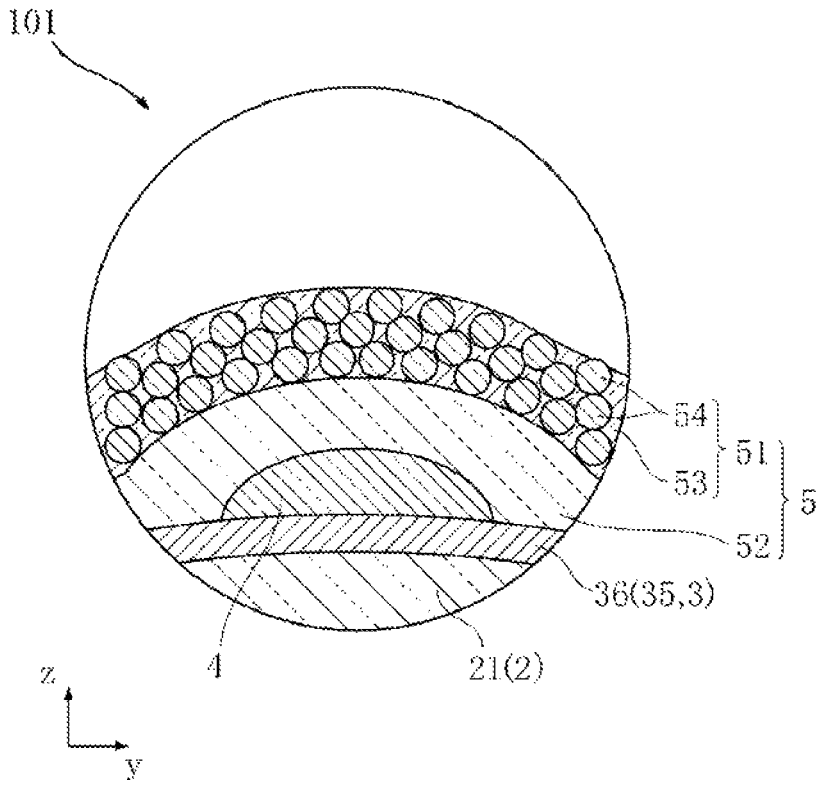
FIG. 5 is a further enlarged section view of major portions of the thermal print head shown in FIG. 1.

The upper layer 51 is one example of a first layer referred to herein. In the present embodiment, as shown in FIG. 5, the upper layer 51 includes a glass matrix 53 and a plurality of alumina grains 54. The glass matrix 53 is made of, e.g., amorphous glass having a softening point of about 780 degrees C. which is higher than the softening point of the amorphous glass making up the lower layer 52. The alumina grains 54 are made of alumina. In the present embodiment, the alumina grains 54 have a spherical shape. The upper layer 51 has a thickness of about 7.5 μm. The alumina grains 54 have an average diameter of about 2.8 μm. In order to attain the intended effects of the present disclosure described later, the upper layer 51, in some embodiments, has a thickness twice to three times as great as the diameter of the alumina grains 54. In the present embodiment, the alumina grains 54 of the upper layer 51 have a concentration of about 60 wt %. With a view to attain the intended effects of the present disclosure described later, the alumina grains 54, in some embodiments, have a concentration of 50 to 70 wt %. As shown in FIGS. 3 and 4, the upper layer 51 is formed in an area ranging from the left end of the substrate 1 to around the center of the intermediate glass layer 25 in the secondary scanning direction y.

The lower layer 52 is formed by thick-film printing glass paste and then sintering the glass paste thus printed. The upper layer 51 is formed by thick-film printing a mixture of glass paste and alumina grains 54 and then sintering the mixture thus printed. By virtue of the sintering process, the alumina grains 54 are sunk in the glass paste. As a result, the occupying percentage of the alumina grains 54 grows higher in the area of the upper layer 51 nearer to the lower layer 52.

The drive IC 71 serves to arbitrarily heat some of the heating portions 41 by selectively applying the electric current to the individual electrodes 35. As shown in FIG. 3, the drive IC 71 is arranged on the die-bonding glaze 22. In the present embodiment, a portion of the electrode layer 3 and a support glass layer 27 are interposed between the drive IC 71 and the die-bonding glaze 22.

As shown in FIG. 2, a plurality of pads 72 is formed on the drive IC 71. The pads 72 are connected through a plurality of wires 73 to the bonding portions 37 of the individual electrodes 35, or to the pads, as portions of the electrode layer 3, formed on the die-bonding glaze 22.

As shown in FIG. 1, the drive IC 71 is covered with an encapsulation resin 82. The encapsulation resin 82 is, e.g., a black soft resin. For the sake of understanding, the encapsulation resin 82 is omitted in FIGS. 2 and 3. A connector 83 is provided in the substrate 1. The connector 83 is connected to a printer-side connector when the thermal print head 101 is assembled with, e.g., a printer.

Next, description will be made on the actions of the thermal print head 101.

With the present embodiment, the alumina grains 54 play a role of preventing generation of scratches on the upper layer 51 when the print paper and the protective layer 5 are rubbed against each other in the printing process using the thermal print head 101. The provision of the glass matrix 53 covering the alumina grains 54 makes it possible to keep the surface of the upper layer 51 relatively smooth. Accordingly, it is possible to increase the speed of the printing operation performed by the thermal print head 101 and to properly print on, e.g., a print paper containing a relatively hard material.

By forming the alumina grains 54 into a spherical shape, it is possible to restrain the alumina grains 54 from being disproportionately distributed in the upper layer 51, thereby assuring uniform distribution of the alumina grains 54. Even when the alumina grains 54 are exposed from the glass matrix 53, it is possible to avoid generation of sharp irregularities on the surface of the upper layer 51.

By setting the thickness of the upper layer 51 to be two times or more as great as the diameter of the alumina grains 54, it is possible to restrain the contours of the alumina grains 54 from conspicuously appearing on the surface of the upper layer 51. This makes it possible to prevent the surface of the upper layer 51 from becoming severely irregular due to the contours of the alumina grains 54. By setting the thickness of the upper layer 51 to be three times or less as great as the diameter of the alumina grains 54, it is possible to arrange the alumina grains 54 so that the alumina grains 54 can overlap with each other in the thickness direction of the upper layer 51. It is also possible to avoid undue increase in the number of layers of the alumina grains 54, which may otherwise make the distribution of the alumina grains 54 uneven. If the distribution of the alumina grains 54 becomes uniform, it is possible to prevent generation of large and deep scratches on the upper layer 51.

The inventors have found that, if the concentration of the alumina grains 54 in the upper layer 51 is about 60 wt %, it is possible to uniformly distribute the alumina grains 54 in the upper layer 51 in a mutually overlapping relationship and to effectively restrain the contours of the alumina grains 54 from appearing on the surface of the upper layer 51. In order to attain such effects, the concentration of the alumina grains 54, in some embodiments, is about 50 to 70 wt %.

Since the softening point of the upper layer 51 is higher than the softening point of the lower layer 52, the lower layer 52 is first softened and the upper layer 51 is kept relatively hard when the temperature of the protective layer 5 is increased during the course of using the thermal print head 101. This makes it possible to restrain the alumina grains 54 from sinking from the upper layer 51 toward the lower layer 52.

FIGS. 6 through 10 show other embodiments of the present disclosure. In these figures, the same or similar components as those of the foregoing embodiment are designated by the same reference symbols as used in the foregoing embodiment.

Figure 6:
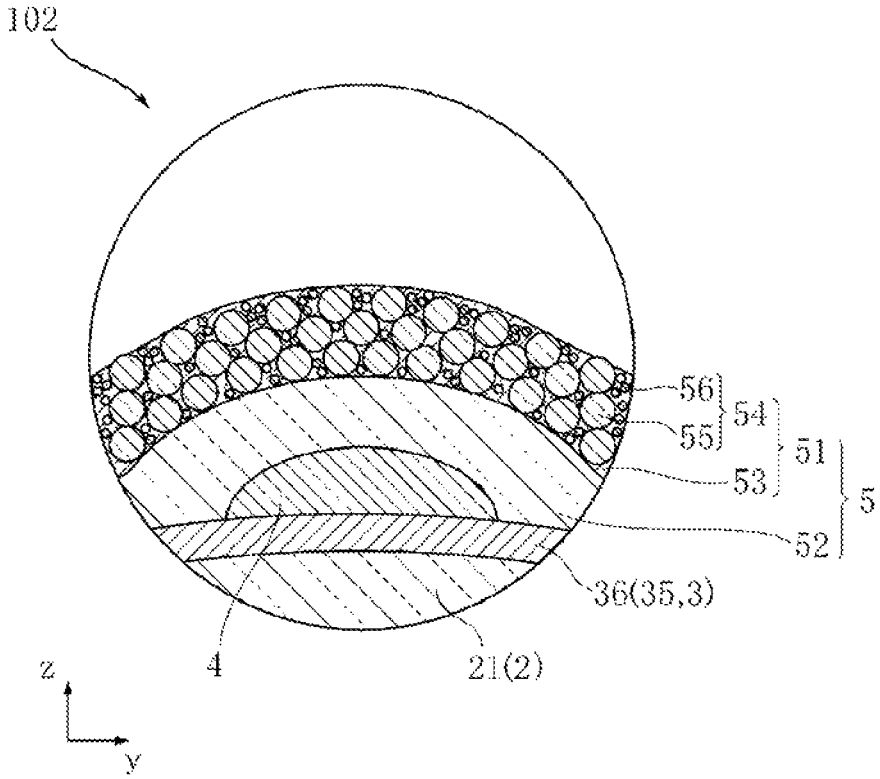
FIG. 6 is an enlarged section view showing major portions of a thermal print head according to a second embodiment of the present disclosure.

FIG. 6 shows a thermal print head according to a second embodiment of the present disclosure. The thermal print head 102 of the present embodiment differs from the thermal print head 101 of the foregoing embodiment in terms of the configuration of the upper layer 51. In the present embodiment, the alumina grains 54 mixed into the upper layer 51 include a plurality of first alumina grains 55 and a plurality of second alumina grains 56. The first alumina grains 55 have a spherical shape and a diameter of about 2.8 μm. The second alumina grains 56 have a spherical shape and a diameter of about 0.7 μm. In the present embodiment, the mixing ratio of the first alumina grains 55 and the second alumina grains 56 is about 2:1 to 1:1. The thickness of the upper layer 51 is about 7.5 μm and is two times to three times as great as the diameter of first alumina grains 55. The concentration of the alumina grains 54 is about 60 wt % and preferably 50 to 70 wt %.

With the embodiment set forth just above, it is possible to increase the speed of the printing operation performed by the thermal print head 102 and to properly print on, e.g., a print paper containing a relatively hard material. The second alumina grains 56 are distributed to fill up the gaps between the first alumina grains 55. This makes it possible to enhance the effect of preventing generation of scratches on the upper layer 51 and to keep the surface of the upper layer 51 smooth. In order to attain these effects, the diameter of the second alumina grains 56, in some embodiments, are equal to or smaller than one half of the diameter of the first alumina grains 55.

Figure 7:
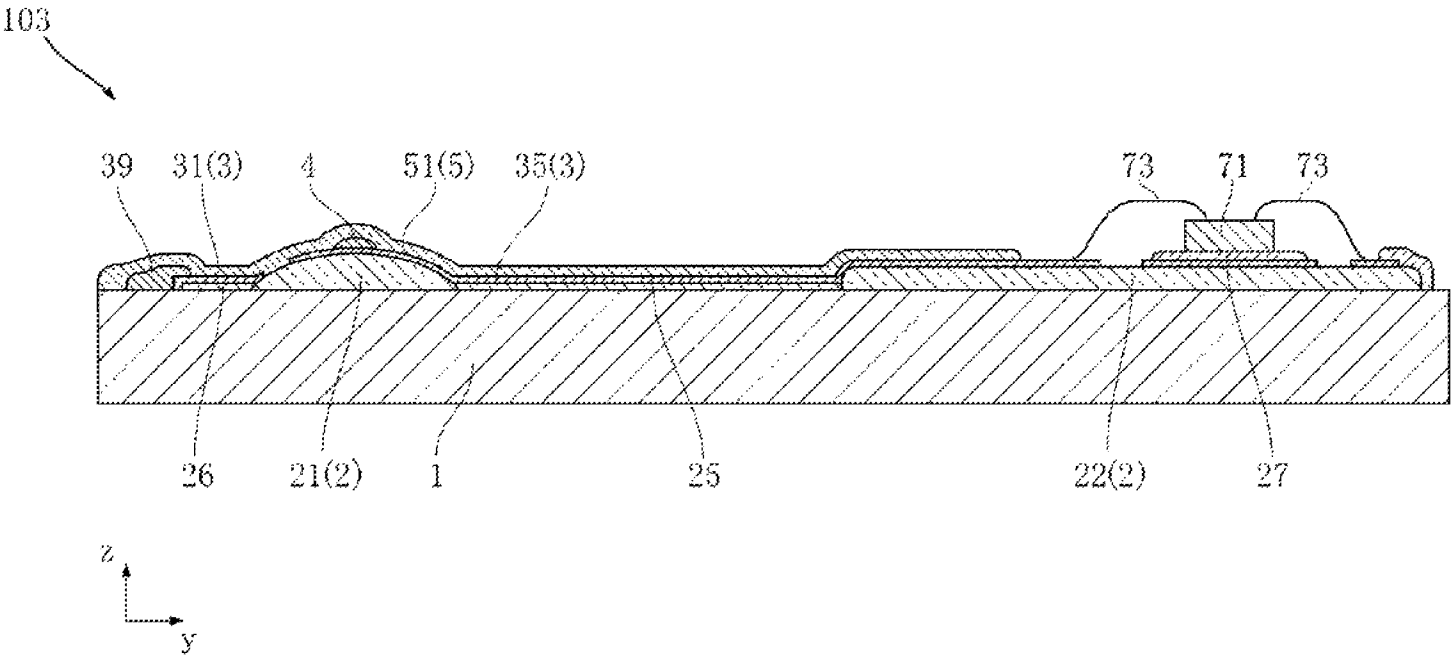
FIG. 7 is a section view showing a thermal print head according to a third embodiment of the present disclosure.
Figure 8:
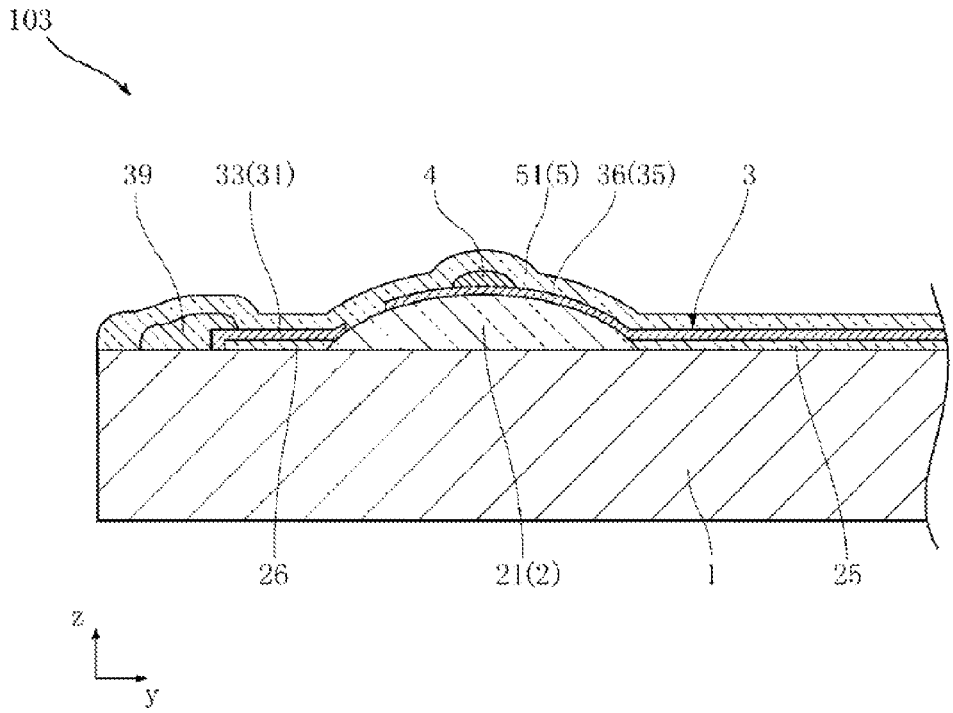
FIG. 8 is an enlarged section view of major portions of the thermal print head shown in FIG. 7.
Figure 9:
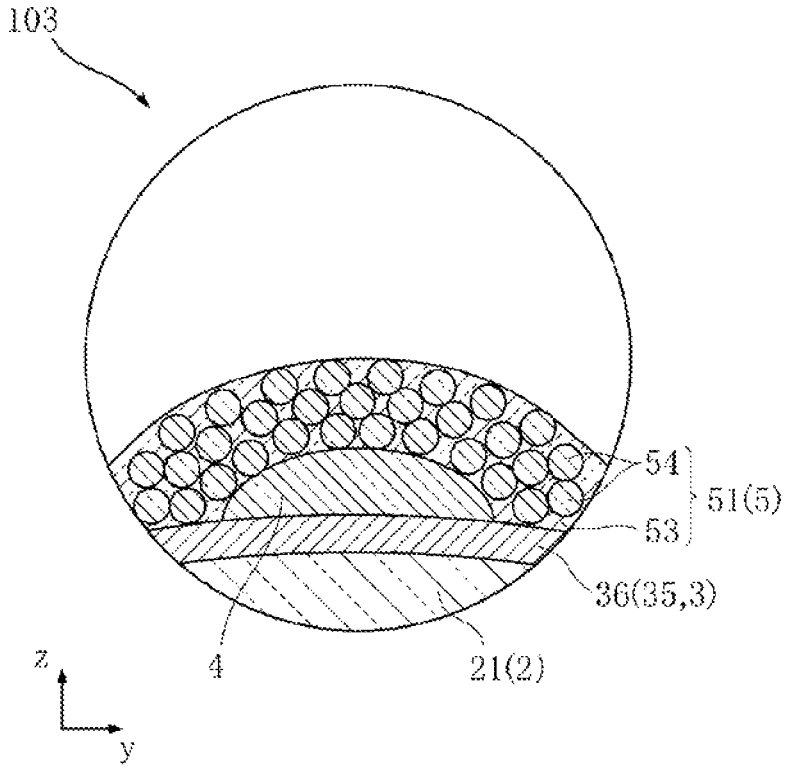
FIG. 9 is a further enlarged section view of major portions of the thermal print head shown in FIG. 7.

FIGS. 7 through 9 show a thermal print head according to a third embodiment of the present disclosure. The thermal print head 103 of the present embodiment differs from the thermal print head 101 of the first embodiment in terms of the configuration of the protective layer 5. In the present embodiment, the protective layer 5 includes only the upper layer 51. The thermal print head 103 of the present embodiment is the same as the upper layer 51 of the thermal print head 101 of the first embodiment in that the upper layer 51 includes the glass matrix 53 and the alumina grains 54. As shown in FIGS. 7 and 8, the upper layer 51 is formed in an area ranging from one end of the substrate 1 in the secondary scanning direction y to around the center of the die-bonding glaze 22 of the glaze layer 2.

With the embodiment set forth just above, it is possible to increase the speed of the printing operation performed by the thermal print head 103 and to properly print on, e.g., a print paper containing a relatively hard material.

Figure 10:
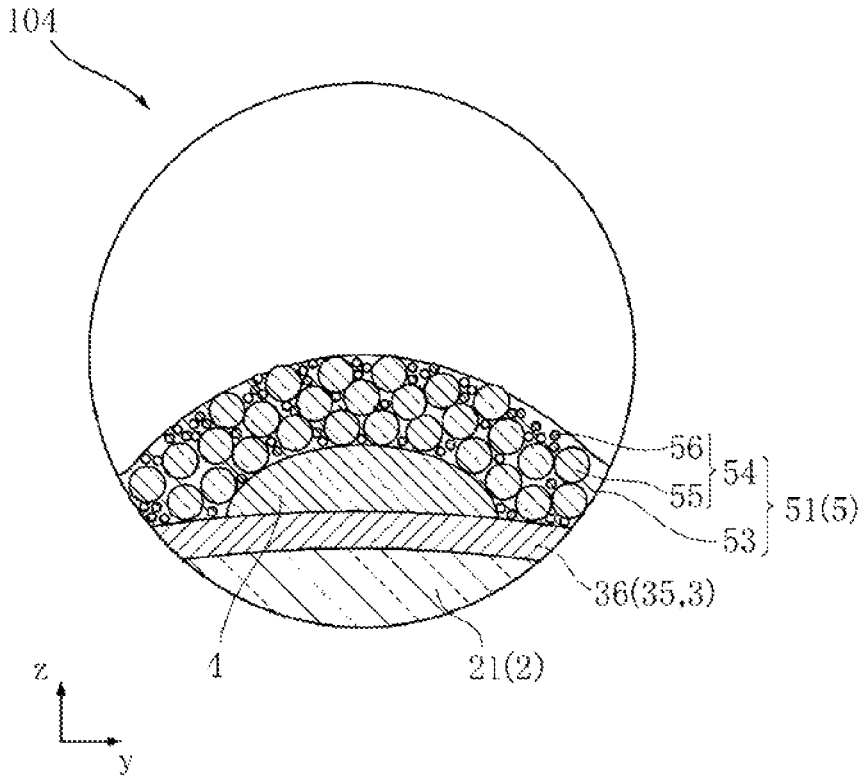
FIG. 10 is an enlarged section view showing major portions of a thermal print head according to a fourth embodiment of the present disclosure.
Figure 11:
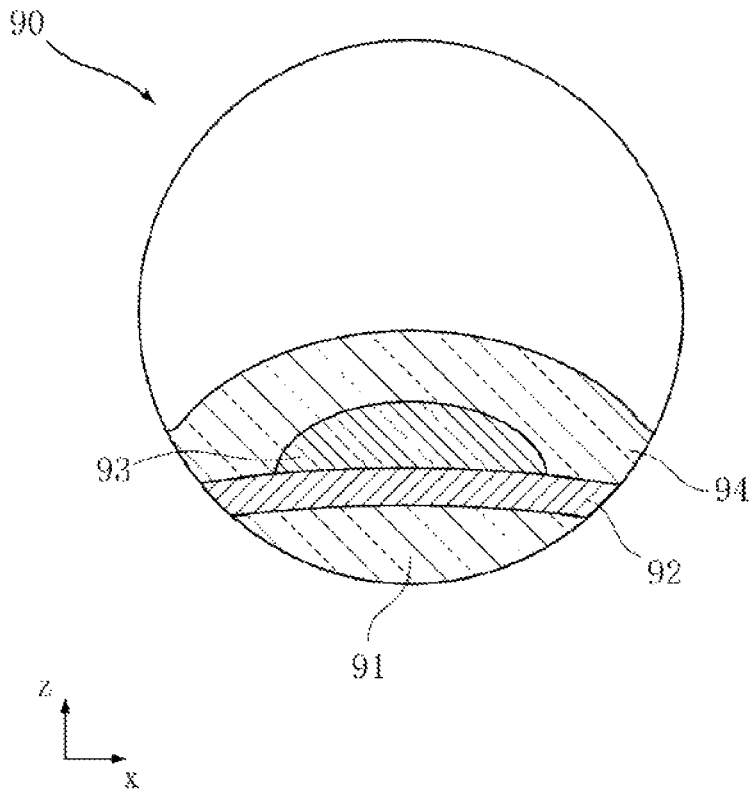
FIG. 11 is an enlarged section view illustrating major portions of one example of a conventional thermal print head.

FIG. 10 shows a thermal print head according to a fourth embodiment of the present disclosure. The thermal print head 104 of the present embodiment is the same as the thermal print head 103 of the third embodiment in that the protective layer 5 includes only the upper layer 51. The thermal print head 104 of the present embodiment is the same as the thermal print head 102 of the second embodiment in that the alumina grains 54 of the upper layer 51 include the first alumina grains 55 and the second alumina grains 56.

With the embodiment set forth just above, it is possible to increase the speed of the printing operation performed by the thermal print head 104 and to properly print on, e.g., a print paper containing a relatively hard material.

The thermal print heads of the present disclosure are not limited to the embodiments described above. The specific configurations of the respective portions of the thermal print heads according to the present disclosure may be designed in many different ways.

While certain embodiments have been described, these embodiments have been presented by way of example only, and are not intended to limit the scope of the disclosures. Indeed, the novel thermal print heads described herein may be embodied in a variety of other forms; furthermore, various omissions, substitutions and changes in the form of the embodiments described herein may be made without departing from the spirit of the disclosures. The accompanying claims and their equivalents are intended to cover such forms or modifications as would fall within the scope and spirit of the disclosures.

What is claimed is:

1. A thermal print head, comprising:

a substrate;

an electrode layer supported on the substrate and provided with a plurality of mutually spaced-apart portions;

a resistor layer provided with a plurality of heating portions arranged along a primary scanning direction, the heating portions lying across the spaced-apart portions; and a protective layer configured to cover the resistor layer, the protective layer including a first layer made of a glass matrix and a plurality of alumina grains mixed into the glass matrix.

2. The thermal print head of claim 1, wherein the alumina grains have a spherical shape.

3. The thermal print head of claim 2, wherein the alumina grains include first alumina grains and second alumina grains smaller in diameter than the first alumina grains.

4. The thermal print head of claim 3, wherein the first layer has a thickness twice to three times as great as the diameter of the first alumina grains.

5. The thermal print head of claim 3, wherein the diameter of the second alumina grains is equal to or smaller than one half of the diameter of the first alumina grains.

6. The thermal print head of claim 3, wherein the first alumina grains and the second alumina grains are mixed in a mixing ratio of 2:1 to 1:1.

7. The thermal print head of claim 2, wherein the first layer has a thickness twice to three times as great as the diameter of the alumina grains.

8. The thermal print head of claim 1, wherein the alumina grains in the first layer have a concentration of 50 to 70 wt %.

9. The thermal print head of claim 1, wherein an occupying percentage of the alumina grains in the first layer is increased toward the resistor layer along a thickness direction of the first layer.

10. The thermal print head of claim 1, wherein the glass matrix of the first layer is made of amorphous glass.

11. The thermal print head of claim 1, wherein the protective layer further includes a second layer interposed between the first layer and the resistor layer.

12. The thermal print head of claim 11, wherein the second layer is made of amorphous glass.

13. The thermal print head of claim 11, wherein the first layer has a softening point higher than a softening point of the second layer.

14. The thermal print head of claim 11, further comprising: a partial glaze made of glass, the partial glaze interposed between the substrate and the spaced-apart portions of the electrode layer, the partial glaze overlapping with the plurality of heating portions when seen in a thickness direction of the substrate, the partial glaze extending in the primary scanning direction and having an arc-like strip-shaped cross-section, the first layer and the second layer extending beyond a terminal edge of the partial glaze in a secondary scanning direction.

15. The thermal print head of claim 14, further comprising: a die-bonding glaze provided in a position spaced apart from the partial glaze in the secondary scanning direction and an intermediate glass layer formed to cover an area of the substrate interposed between the partial glaze and the die-bonding glaze, the second layer extending beyond the intermediate glass layer to the die-bonding glaze, the first layer provided with a secondary scanning direction terminal edge overlapping with the intermediate glass layer.

16. The thermal print head of claim 15, further comprising: a tip end glass layer configured to cover an area of the substrate positioned at the opposite side of the partial glaze from the intermediate glass layer, the first layer and the second layer extending beyond a terminal edge of the tip end glass layer in the secondary scanning direction.

17. The thermal print head of claim 11, wherein the electrode layer includes: a common electrode provided with a connecting portion extending in the primary scanning direction and a plurality of strip-shaped portions extending from the connecting portion in the secondary scanning direction; and a plurality of individual electrodes provided with strip-shaped portions extending in the secondary scanning direction and lying between the strip-shaped portions of the common electrode adjoining to each other in the primary scanning direction, the resistor layer intersecting the plurality of the strip-shaped portions of the common electrode and the strip-shaped portions of the plurality of the individual electrodes and extending in the secondary scanning direction.

18. The thermal print head of claim 17, wherein the electrode layer contains Au, and further comprising: an auxiliary electrode layer containing Ag, the auxiliary electrode layer configured to at least partially cover the connecting portion, the first layer and the second layer extending beyond a terminal edge of the auxiliary electrode layer in the secondary scanning direction.

19. The thermal print head of claim 1, further comprising: a partial glaze made of glass, the partial glaze interposed between the substrate and the spaced-apart portions of the electrode layer, the partial glaze overlapping with the heating portions when seen in a thickness direction of the substrate, the partial glaze extending in the primary scanning direction and having an arc-like strip-shaped cross section, the first layer extending beyond a terminal edge of the partial glaze in a secondary scanning direction.

20. The thermal print head of claim 19, further comprising: a die-bonding glaze provided in a position spaced apart from the partial glaze in the secondary scanning direction and an intermediate glass layer formed to cover an area of the substrate interposed between the partial glaze and the die-bonding glaze, the first layer extending beyond the intermediate glass layer to the die-bonding glaze.

21. The thermal print head of claim 20, further comprising: a tip end glass layer configured to cover an area of the substrate positioned at the opposite side of the partial glaze from the intermediate glass layer, the first layer extending beyond a terminal edge of the tip end glass layer in the secondary scanning direction.

22. The thermal print head of claim 19, wherein the electrode layer includes: a common electrode provided with a connecting portion extending in the primary scanning direction and a plurality of strip-shaped portions extending from the connecting portion in the secondary scanning direction; and a plurality of individual electrodes provided with strip-shaped portions extending in the secondary scanning direction and lying between the strip-shaped portions of the common electrode adjoining each other in the primary scanning direction, the resistor layer intersecting the plurality of the strip-shaped portions of the common electrode and the strip-shaped portions of the individual electrodes and extending in the secondary scanning direction.

23. The thermal print head of claim 22, wherein the electrode layer contains Au, and further comprising: an auxiliary electrode layer containing Ag, the auxiliary electrode layer configured to at least partially cover the connecting portion, the first layer extending beyond a terminal edge of the auxiliary electrode layer in the secondary scanning direction.

* * * * *